US006598416B1

(12) United States Patent
Grobbelaar

(10) Patent No.: US 6,598,416 B1
(45) Date of Patent: Jul. 29, 2003

(54) FUNDAMENTS AND SYSTEM FOR GENERATING POWER AND PORTABLE WATER

(76) Inventor: Christian Grobbelaar, 461 Queens Crescent, Lynnwood, Pretoria (ZA), 0081

( * ) Notice: Subject to any disclaimer, the term of this patent is extended or adjusted under 35 U.S.C. 154(b) by 0 days.

(21) Appl. No.: 10/049,364

(22) PCT Filed: Mar. 10, 2000

(86) PCT No.: PCT/ZA00/00044

§ 371 (c)(1),
(2), (4) Date: Jun. 5, 2002

(87) PCT Pub. No.: WO01/11199

PCT Pub. Date: Feb. 15, 2001

(30) Foreign Application Priority Data

Aug. 6, 1999 (ZA) ..... 99/5042
Jan. 10, 2000 (ZA) ..... 2000/0026

(51) Int. Cl.[7] ..... F25D 15/00; F25B 1/00; F03G 7/00

(52) U.S. Cl. ..... 62/331; 62/116; 62/260; 60/641.3

(58) Field of Search ..... 62/331, 498, 510, 62/115, 116, 260; 60/641.2, 641.3; 165/45

(56) References Cited

U.S. PATENT DOCUMENTS

| | | | | |
|---|---|---|---|---|
| 4,116,009 A | | 9/1978 | Daubin | |
| 4,201,060 A | * | 5/1980 | Outmans | 60/641.2 |
| 4,389,858 A | | 6/1983 | Jepsen | |
| 5,911,684 A | * | 6/1999 | Shnell | 60/641.2 |

FOREIGN PATENT DOCUMENTS

| | | |
|---|---|---|
| FR | 2134797 | 11/1972 |
| LU | 42638 | 10/1962 |

* cited by examiner

*Primary Examiner*—Chen-wen Jiang
(74) *Attorney, Agent, or Firm*—McDonnell Boehnen Hulbert & Berghoff

(57) ABSTRACT

Studies of the variation in latent heat of fluids with temperature and the rate of heat increase with compression were applied to thermodynamic cycles represented in columns (190, 193, 199). This showed that heat may be circulated and that power output (194) can be boosted by catalysts. Practical layouts show that the present 45% efficiency of thermal power stations may be doubled. The invented layouts produce power from reject heat (185, 188) and saves the water required of cooling thermal power stations.

30 Claims, 5 Drawing Sheets

Figure 3:
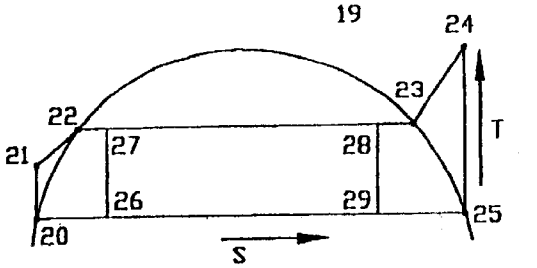

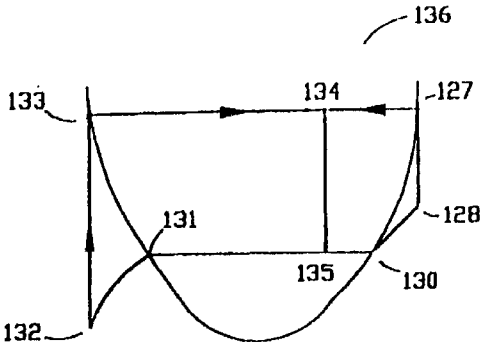
FIG. 10
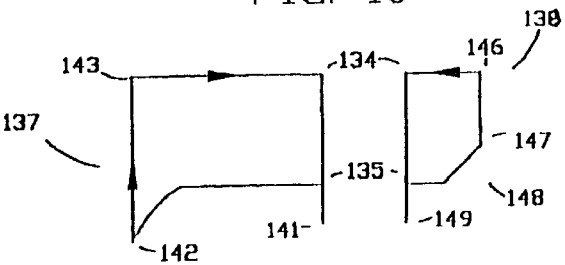
FIG. 11
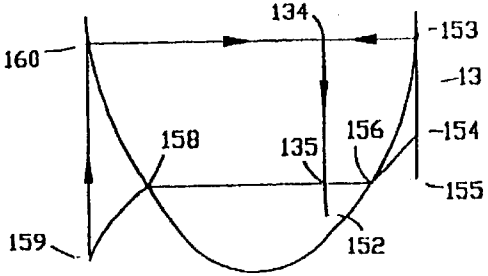
FIG. 12
FIG. 13
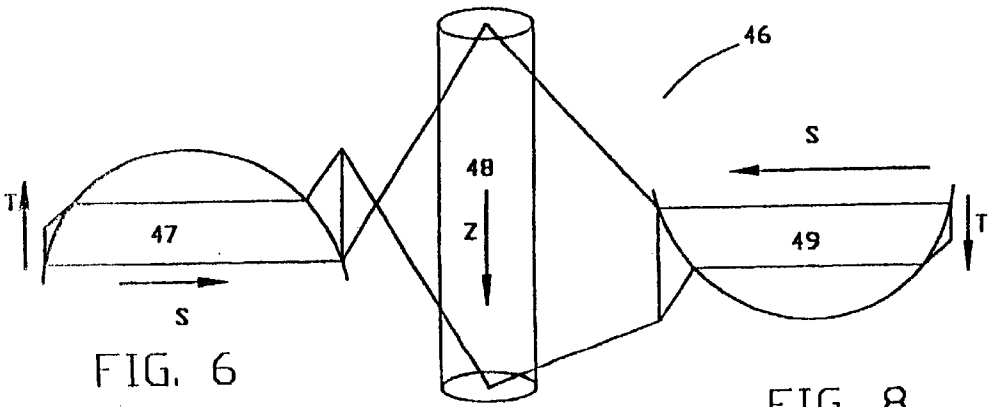
FIG. 8
FIG. 7
FIG. 6
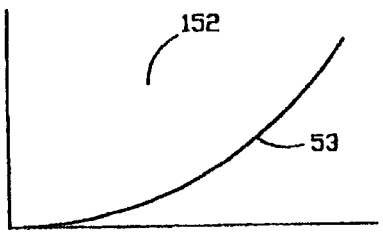
FIG. 9

FUNDAMENTS AND SYSTEM FOR GENERATING POWER AND PORTABLE WATER

FIELD OF THE INVENTION

This invention relates to the fundamental principles of combining different types of energy and systems for converting energy into power, and more particularly for converting heat energy into electric power energy, mostly with gravitational acceleration, according to improvements of the methods and systems disclosed in South African patent number 97/1984 and patent application 98/8561 which has not been published.

BACKGROUND TO THE INVENTION AND THE STATE OF ART

Denotation: Represent depth below surface by z, measured positive downwards; g to denote gravitational acceleration and m to be mass. For purposes of this application the term:

"N" is the ratio of two energy values like two latent heat values;

"T-s diagram" means the presentation on a graph with scales of temperature and entropy, of the state of condition of a fluid subject to variable temperature and energy levels;

"Work" is one of the forms of energy;

"Cycle" means a thermodynamic T-s cycle as presented in a T-s diagram and/or a mass circulation system operating in a closed loop;

"Preheating" means to increase the energy and/or entropy of a fluid;

"Drenching" means the addition of low entropy fluid(s) to a high entropy fluid(s) to reduce the high entropy of the formed fluid. The lower level of the high entropy limit of the entropy state of condition can also be reached by heat extraction and/or incomplete heat supply to fluid, "Power Cycle" includes thermodynamic cycle(s) employed to produce more output power than power consumed to complete the cycle. In the "conventional" power cycle fluid is pressurised, vaporised or gassified by the addition of heat, depressurised to do work, liquefied by the removal of heat in a continual process to form a cycle. In this document the power cycle includes a cycle in which low entropy fluid, preheated and drenched to any convenient level, is pressurised mostly by gravity, the pressurised fluid is partly depressurised to produce power, heated to higher entropy level by addition of heat, depressurised further by elevation against gravity, fluidised or liquified by the removal of heat in a continual process to form a cycle. The entropy extent of the power cycle is conveniently reduced to a more profitable value by preheating and/or drenching to produce less netto work per cycle and to produce globally more work per co-operating countercycle of a refrigeration fluid.

"Refrigeration Cycle" means a "conventional" cycle that discards heat at high, or high and intermediate temperature(s), consumes heat at low, or low and intermediate temperature(s) and consumes and produces heat and work in circulation. fluid(s),mostly gas or vapour at high entropy level is pressurised to a significant extent by gravity in being lowered in a column, is vaporised or liquefied to be a low entropy fluid by the release or rejection of heat, to become a liquid and/or vapour or pre-heated vapour, in order to be of decreased entropy, the low entropy fluid becomes pressurised mechanically and depressurised to a significant extent by gravity, in moving up a column, the depressurised fluid heated by receiving heat to become a gas or vapour or drenched to be a high entropy fluid, recirculated to become a continual cycle.

"Countercycle" mens a cycle running in the opposite sense compared to another cycle. In this document a countercycle includes two thermodynamic cycles operating as a combination as a power cycle and a refrigeration cycle, mostly in the sense that the refrigeration cycle prescribes the operation of the power cycle and the combined countercycle consumes heat and produces power. Commonly the temperature range of the refrigeration cycle must be cooler at the cold end and hotter at the hot end of the two thermodynamic cycles. In this document the dominance of the refrigeration cycle over the power cycle is maintained in the sense that power input to the refrigeration cycle maintains the running of countercycles, even if the two or more cycle fluids are mixed to operate at the same temperatures.

For purposes of this application Countercycle Power Production is obtained by running a power T-s cycle inside or up to the boundary of a refrigeration T-s cycle.

Heat engines and refrigeration systems are well known in the art and have been subjected to extensive theoretical analysis. Typically the systems operate on closed circuits of fluid.

With heat engines the fluid is pressurised and then heated, to cause an increase in temperature and pressure. The pressurised fluid is then made to do work, usually by driving a turbine whereafter heat and energy is removed from the system to be pressurised again. Generally, the fluid will be in a liquid state before heating and in a gaseous or superheated gas state after heating.

With refrigeration systems a fluid in gas and/or fluid state is compressed mechanically and/or mostly by gravity, which heats the fluid. Heat is removed in a heat exchanger and/or fluid mixer and discarded from the refrigeration fluid. Thereafter the compressed fluid is depressurised mostly against gravity and/or to do work and cool by evaporation. At the lower pressure the fluid is allowed to vaporise partially or in whole to consume heat at low temperature. The low pressure vapour and/or liquid is then pressurised mechanically and/or by gravity to repeat the cycle.

Typical examples of the use of heat engines are power stations, and of refrigeration systems are household refrigerators. Some mine cooling systems performs work to reduce the internal, potential, velocity and/or gravitational energy.

Although the power and refrigeration systems tend to function well, they also tend to be inefficient due to a number of factors, such as mechanical and thermodynamic inefficiencies inherent in equipment used to do work, and the need to reject heat and/or energy.

South African patent number 97/1984 discloses a method of performing work in a cyclic manner. The method being characterised in that the gas and liquid are pressurised to a significant extent by the action of gravity in columns.

State of the art features applied are hysteresis loops, velocity energy, and common T-s diagram applications.

A yet further feature of the above patent provides for heat flow into the cycle(s) to be used in energy conversion, applying countercycles of fluid at different temperature values, consuming low grade heat and even in freezing water in the process of producing electric power.

The above patent further provides for a system for performing work substantially as described above comprising a closed circuit defining a flow path, the circuit being oriented to have an upper and a lower end and such that the action of gravity will cause a predetermined pressure difference in a fluid contained therein between the ends of the flow path.

The patent therefore includes gravitational refrigeration of water and power generation in countercycles by applying fluids having dissimilar latent heat exposures. The new application claims new versions of the above which change the application of the academic principles to become practical production units as described in the examples, and displayed in the figures.

The applicant's co-pending South African complete patent application number 98/8561 has not been accepted and has not been published. It describes methods for performing work by the countercycle method including drenching of the power cycle up to 50%. The present application describes variable drenching and/or preheating up to or more than 50%, the gas and liquid being pressurised and depressurised to a significant extent by the action of gravity, the method being characterised in that the density of the fluid in the column is increased by drenching the vapour with a liquid component of the fluid or drenching it by a catalyst fluid or drenching it by any fluid. The new application includes drenching by internal countercycles of similar fluid(s) or mixtures of fluids exceeding 50% drenching.

The unpublished patent application 98/8561 further discloses a method for performing work in thermodynamic countercycle in which temperature differences for heat transfer are obtained by applying two fluids with different rates of heat increase for shaft depth increase, applied in a manner which causes heat flow at shallow depth from one fluid to the other and at greater depth to cause reverse heat flow between the fluids. This has now been extended to fluids of similar rates of heat increase and for a continuous variation in fluid mix entropies.

The proceeding definitions of terms and figures are applied onwards without limiting the invention by the abbreviated descriptions. The description of the examples and figures are local descriptions only. The basic theories will apply universally and beyond the examples.

Figure 1:
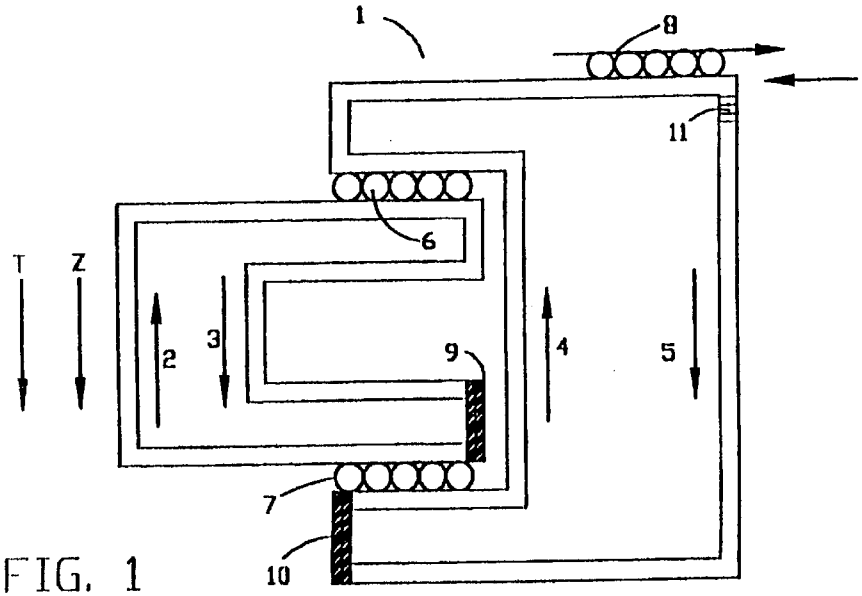

The state of art including patent ZA971984 is illustrated in FIG. 1 and in the following example which is theoretically correct but unpractical.

State of the art example: From patent ZA971984, example 2 it is calculated that power can be produced as shown diagrammatically in FIG. 1 of this document. Columns or shafts of 3574 meters length numbered 2, 3, 4 and 5 are filled with C318 gas and/or vapour, C318 liquid, HFC134a liquid and HFC134 vapour and/or gas. Input heat exchanger 8 balances the power energy withdrawn at 9. Heat transfer occurs in heat exchangers 6 and 7. The power yield is 14.8 kJ/kg. The unappropriated shaft lengths and heat exchangers 6 and .7 are addressed in this text and in FIGS. 14 and 17 of this application.

In thermodynamics most operations involving heat may be typified in the classic T-s diagram shown in FIG. 3 by state At condition points 20, 21, 22, 23, 24, 25 and 20.

The teams of "preheat" and "drench" are shown in FIG. 3. If heat is applied at 20 the fluid becomes preheated to (say) state of condition 26. If power (pressure i.e. work) is applied at 26 the state of condition chance to 27 which is also a state of condition of preheat. The entropy of 20 and 21 is increased at 26 and 27. Similarly the state of condition "gas" at 24 and 25 is changed to "vapour" by withdrawing heat, to state of conditions 23, 28 and 29. The new term "drenching" implies that the high entropy of superheated gas or gas at state of conditions 24, 25 and 23 is decreased. The application of preheating and drenching eventually change the shape of the convention T-s diagram to a rectangular or square shape like 26, 27, 28, 29, 26. This T-s shape modification eliminates superheating and it is hereafter commonly applied. Patent 97/1984 states that a refrigeration cycle encircles a power cycle(s) as shown in T-s diagrams in FIGS. 4 and 5.

A significant point of the state of art is illustrated in FIGS. 6, 7 and 8. The conventional condition of state T-s diagram 47 and the conventional shaft length 48 are in conflict as shown by the dotted liens between 47 and 48. The display change of 47 to 49 by rotation or inversion as defined in patent ZA971984 brings dimensions in correspondence.

Figure 18:
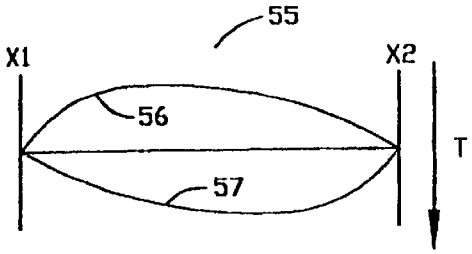
Figure 20:
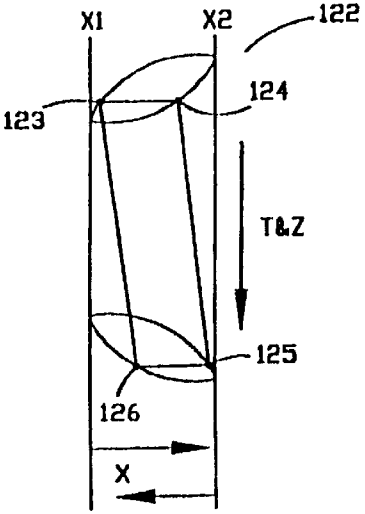

The T-X hysteresis loop in FIG. 18 is common but its application in FIG. 20 is new. Components of energy are well known. Reference to potential energy in the form of gravitational acceleration and of velocity energy created in jetting, are applied in the inventions.

OBJECT OF THE INVENTION

It is an object of the present invention to provide methods and systems for converting heat into electric power, by extending the state of the art with improvements to and additions to the methods and systems disclosed in previous patents. It exceeds on previous patents in proposing workable power generation layouts and refrigeration layouts which invite stray heat to be converted to power in 4, 3 or 2 operating shaft layouts. This utilises detailed information of the behaviour of practical thermodynamic fluids, and applies changes in material behaviour associated with induced changes in property and entropy levels of fluids and catalysts.

DESCRIPTION OF THE INVENTION

Figure 19:
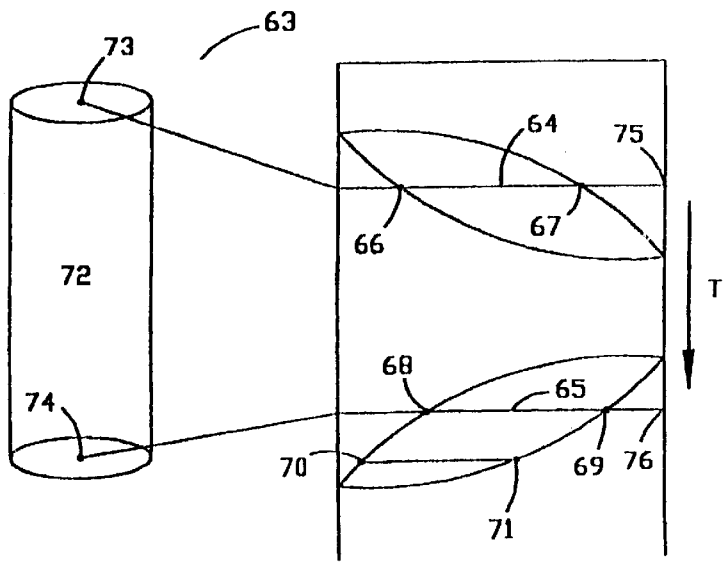

The invention is expanding the state of the art information and new methods. The invention includes principles of invented theory, heat balance induction, practical designs, internal countercycles, new techniques to multiply output with the application of preheated and drenched countercycles, etc. The cycles are driven by internal heating on applying gravitational compression on reshaped and equal temperature T-s diagrams. This magnifies output as shown in FIG. 9. The two column countercycles are based on new interpretations of hysteresis loops subject to gravitational acceleration applying N times countercycles and controlled by regulated temperatures at the top and bottom of shafts as shown in FIGS. 19 and 20. The preferred three column layout is utterly manageable by controlling only the pumping rate. It applies the new internal countercycle T-s diagram principle shown in FIG. 13. The new fluids composition in the three column layout, may consist of any single or multi-mixed substance qualifying only to safety, inflammability, specified viscosity, density etc. The latter "density" becomes a design feature in so far as, increased pressure limits the physical layout size and improves performance. Ammonia, for example can be pressurised to decrease the vapour volume from 323 liter/kg at 0.382 Mega pascal to 25 liter/kg at 4.8 Mega pascals. Carbon dioxide as a monofluid in countercycle operates at temperatures below the temperature of the surround and this invites the entry of stray energy. The design pressurising fits the state of the art knowledge on pressure underground in mines and applied in rock engineering as well as with new invented feature to supply power "on the job" without contaminating the environment. The substances ammonia and carbon dioxide lend themselves to catalyst action by water. The invention extends to all fluids.

DESCRIPTION AND EXPLANATION OF DRAWINGS

FIG. 1 is a schematic display of four working shafts 2, 3, 4 and 5 filled with two thermodynamic fluids which are not shown. Heat energy is converted to electric power at 9. The system is continual if circulation pump 10 lifts the liquid in 4. The liquid is formed in heat exchanger 7 and evaporated in heat exchanger 6. The second fluid is condensed in reverse, in heat exchangers 7 and 6. The second fluids in column 3 is compressed by gravity to drive the generator 9 and may require vapour compressor 11. Details are contained in the state of the art example.

Figure 2:
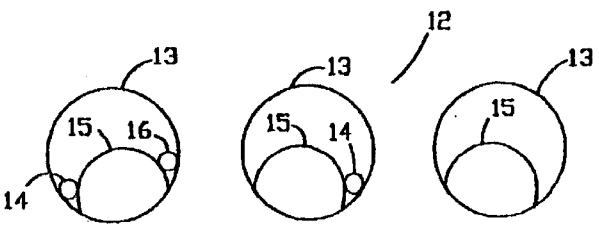

FIG. 2 shows sections of a modified layout of columns 2, 3, 4 and 5 in display 1. Display 12 is rewarding for design since shell 13 resists the fluid system's global pressure and shells 14, 15 and 16 need to resist partial pressure only. Depending on the design pressure of the fluids, the three internal column shells may profitably be inside or alongside one another at the best remunerating choice. This also holds if only three or two columns are applied.

FIG. 3 displays, the classic and known T-s diagram between state of condition points 20, 21, 22, 23, 24, 25 and 20. The T-s diagram may be preheated according to the design, say, to line 26–27. Similarly it may be drenched to line 28–29. Note that the remaining T-s diagram is the rectangle 25, 27, 28, 29 enclosing fluid only and it is void of superheated gas.

Figure 4:
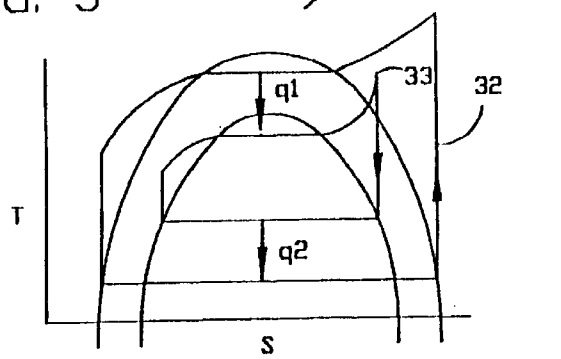

FIG. 4 displays a power cycle 33 completely encircled by a refrigeration cycle 32. Consequently the power cycle action is completely dominated by the refrigeration cycle which supplies heat $q_1$ and absorbs reject $q_2$. Instability in 31 will be created if energy of any type or form, enters or leaves display 31. It can be envisaged that electricity leaves at 33 and that balance is resorted to display 31 by supplying heat energy to cycle 32 or 33.

Figure 5:
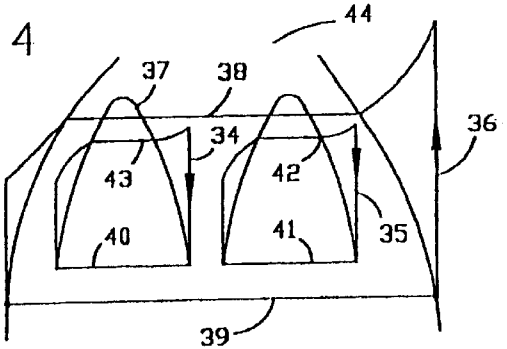

FIG. 5 displays two power cycles 34 and 35 encircled by refrigeration cycle 36. If cycles 34 and 35 are similar, twice the netto power from 34 may exceed the netto power consumed by 36. This means that netto power is produced by display 44. The former reference "twice" will hereafter be called N times.

Excessive power yield from 34 and 35 is against the first law, unless input heat is supplied at, say, 39. If heat 40 plus 41 is less than heat 39, N must be bigger than two and the netto power yielded by 44 can be increased from two times to N times if the heat shortfall at 39 is not over expropriated. Heat may be supplied to 40 and 41 up to a level that hot end heats 38, 42 and 43 are in balance. In this case N can be increased further than described above.

FIGS. 6 to 8 in display 46 illustrates a shaft or column 48 and two T-s diagrams. The conventional T-s diagram 47 is the same as 49 except that the signs of T and of S are reversed. In FIG. 8 the work column can be simulated directly with the shaft. For the conventional T-s diagram 47 the simulation lines cross.

Note: If friction is disregarded, a kilogram fluid subject to the state of condition on top of FIG. 48 may be freely contained and lowered to the bottom where it will gain condition of state of "shaft bottom". It may be returned to the top to its original state of condition. Reasoning shows that the enthalpy change along the length of the shaft 48 is the same as the enthalpy change along the work line of FIG. 8, only over one specific shaft depth, called z.

FIG. 9 shows the graph of increased power yield according to the state of entropy drenching of fluid HP80, provided that the HP80 power Cycle is encircled by a refrigeration cycle. The increased power yield with the association of shafts stems from the total output yield being equal to the smaller yield of a drenched cycle multiplied by the larger N number of cycles inside the refrigeration cycle.

FIGS. 10 to 13 expand on FIG. 3 rotated by 180°. The conventional cycle in FIG. 10 may be slit into, a power cycle 134, 135, 131, 132, 133, 134 and a refrigeration cycle 134, 135, 130, 128, 127, 134. The two cycles are creating an internal countercycle. The power and refrigeration cycles are shown separately in FIGS. 11 and 12. The two cycles may be run simultaneously in vertical shafts of equal length. The first shaft is filled with gas and/or vapour component 142–143. The third shaft contains the components are 127, 128 and 129, this being the liquid shaft for pumping liquid to the top. In the intermediate shaft the components 141–134 and 149–134 are mixed on top and allowed to pressurise one the other in going down to beyond the T-s diagram to state of condition 135, up to 152: At this state of condition power may be extracted up to state of condition 135. Here the depressurised vapour may be split to complete cycle components 135–159 and 135–154.

After completing the two internal countercyles in FIG. 13, power leaves the system and this must cause an energy shortfall which can conveniently be compensated for by heat input along line 153–160. In the absence of heating the system in FIGS. 10 to 13 cause global freezing. It delivers power without compensation. Stability is reached with heat supply.

Figure 14:
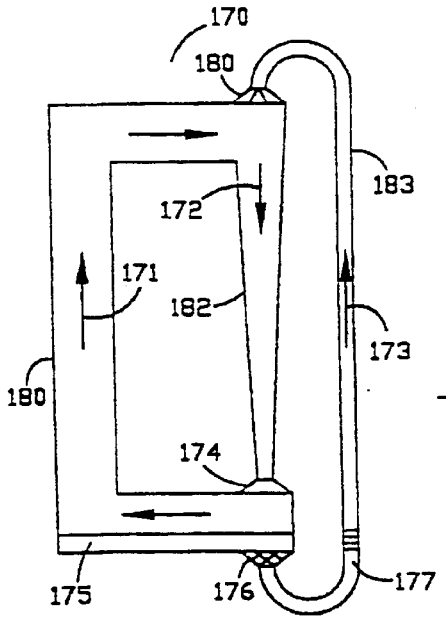
Figure 15:
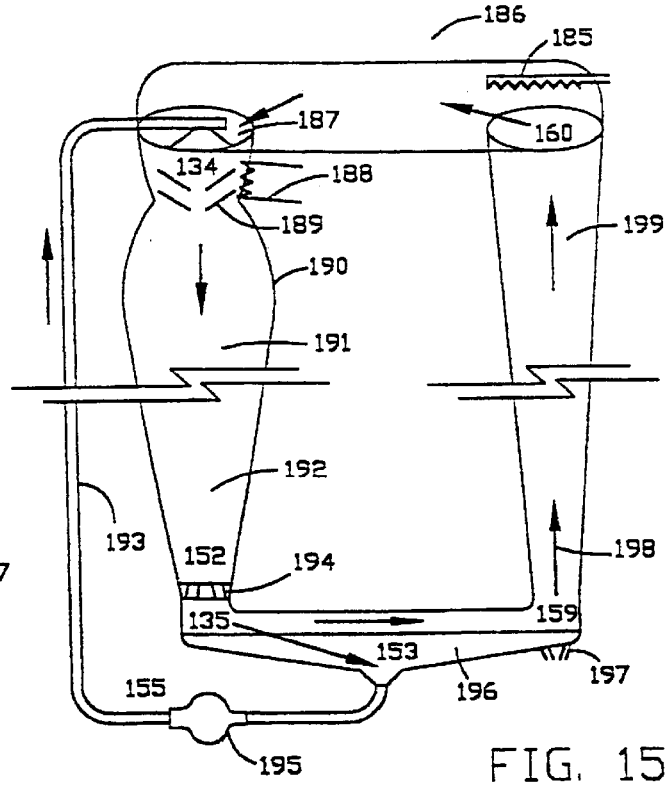

FIGS. 14 and 15 are displays for preferred layouts of a number of examples applied to produce the power in a three column physical layouts. The conical shafts allow the velocity energising of fluid in, for example, 172 to store velocity energy, which reduces the physical size of the layout and the total volume. It creates a better condition of state for extracting power energy. The layout in FIG. 14 contains liquid in 173 and 175, and vapour in the rest of the voids. FIG. 15 is a display of the preferred section through a 3 column power station. It shows a layout adapted specifically to employ catalytic actions like mixing water and ammonia fluids, water and carbon dioxide, or water and compressed air. Dispersion occurs at 187, heat input at 188 and/or 185, mixing, jetting and induction of velocity energy at 189. The mixed mass 191 is pressured and accelerated before passing power generator 194. The water component in 194 is circulated with pump 195 and the vapour, like ammonia gas rises through 198 to complete all cycles.

Figure 16:
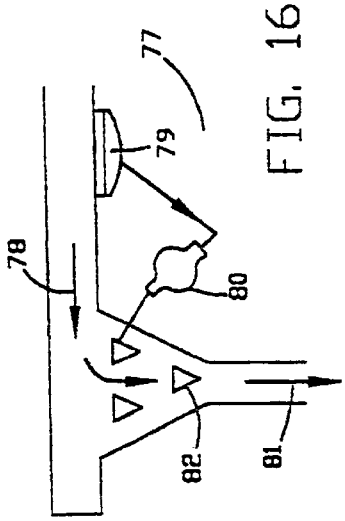

FIG. 16 illustrates a layout where horizontally flowing vapour 78 is velocity energised in 82 to increase velocity, increase pressure etc on leaving column at 81. Velocity energy may be applied by extracting liquid at 79, pressurising the liquid in pump 80 to change the state of condition of the vapour.

Figure 17:
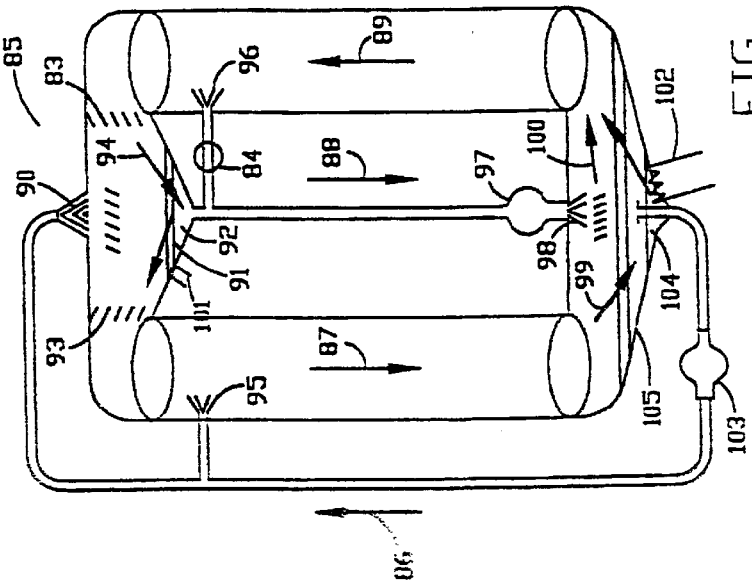

FIG. 17 illustrates a power generation layout operating in four working shafts, 86 containing pressurised carbon dioxide liquid from 105, to be distributed by 90 to sprinkle upcoming R125 vapour (89) to be condensed by evaporation of carbon dioxide. The carbon dioxide vapour is heavier than the F125 vapour and flows downward shaft 87 to be condensed at 99 to form liquid 105 for recycling. Carbon dioxide forms the refrigeration cycles. The R125 forms the power cycle, by being evaporated at 100 on receiving heat from $CO_2$, being of low density the vapour moves up column 89, cools in rising, liquifies at 94, flows down 88 to produces hydraulic power at 97 before being dispersed at 98 for re-evaporating. Since N is larger than one the generated power is more than the input power to the carbon dioxide. The power delivered must be compensated for by adding heat at 102, 83 and/or 101.

FIG. 18 shows a known T-X loop between two fluids $X_1$ and $X_2$ which are mixed in a proportion X between 0 and 100%. If T is scaled positive downwards like z, loop line 56 is the liquid condensation equilibrium line and 57 the gas evaporation equilibrium line. In the symmetric loop in display 55, the two boiling temperatures of the two pure fluids are the same.

FIG. 19 illustrates the change in the hysteresis loop of two fluids as a result of gravitational compression from 73 at the top of a column to 74 at the bottom of the column. If the rate of temperature increase for increased pressure of the two fluids are not the same, the two hysteresis loops become rotated as shown in 63. If the loops in 63 are mirror images, and the shaft related lines pass through the centres of the loops, equal amounts of gas and liquid are formed at the top and the bottom of the shaft. Rotation may be induced as discussed later in FIG. 20. Heating change the operating temperature from 68–69 to 70–71. At 70 most of liquid $X_1$ is condensed and less of $X_2$ is evaporated at 71. This cause column fluid instability which may produce power. It may also cope for unequal latent heats of the two fluids.

FIG. 20 is a T-X diagram to fit examples 8 or 10 with mixed fluid inside a two or four column operating systems to produce power without or with less mechanical pressurisaton. Lines 23/24 and 25/26 are not of equal length. The correct temperature interval choice as modified with velocity energy will cause the result that precisely N times of a specified fluid will evaporate at top and bottom to maximise pro duction. Apply display 77 in FIG. 16.

Figure 21:
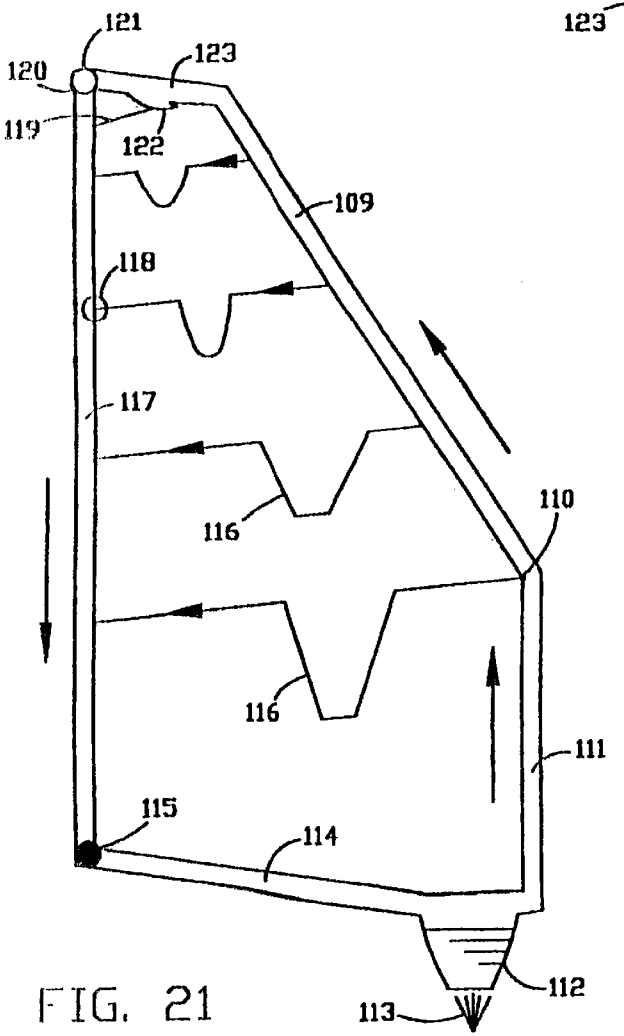

FIG. 21: Shafts 117 and 111 are vertical, the first to collect gravitationally driven fluid to produce power at 115. Latter shaft 111 conveys heated vapour which is not condensing vertically, to loose temperature and joins skew shaft 109. Condensing liquid in 109 is collected and stepwise transferred by a series of pipes numbered 116 to the vertical column 117 for drenching and accelerating fluid. Each duct is equipped with a partial filled U-tube loop to eliminate vapour gas pressure equalising in shafts 117 and 109.

In the layout in FIG. 21 gasses like $CO_2$ and R125 will produce power without pumping since R125 will rise in 111 and 109 to cool, liquify and drench mixed fluid. The dense $CO_2$ vapour will complete the two cycles for delivering power by distillation as shown in FIG. 20.

Figure 22:
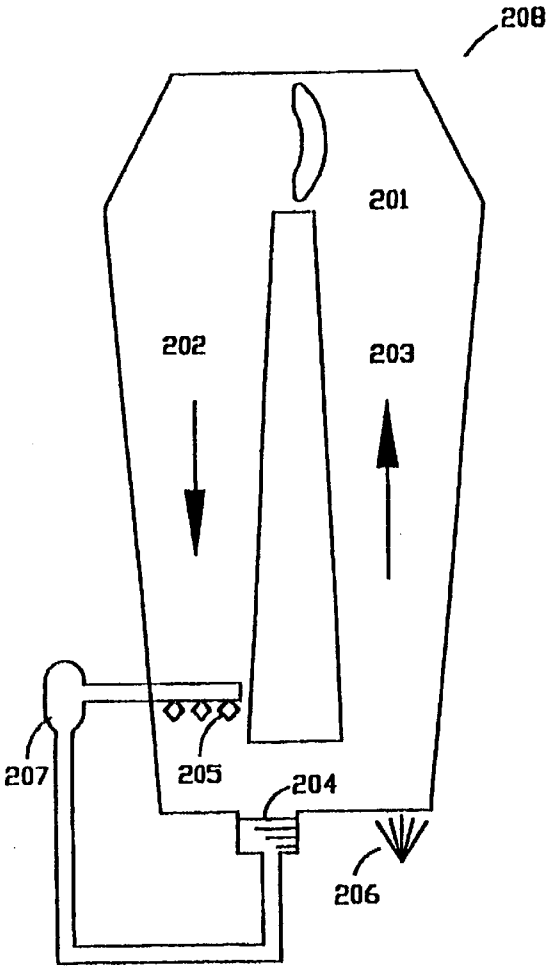

FIG. 22 shows two working vapour columns 203 and 202. The gas rotates on being heated at 206 and power is drawn off at 201. A velocity energy system sucks liquid from 204 apply jet energy at 205 and controls production.

Figure 23:
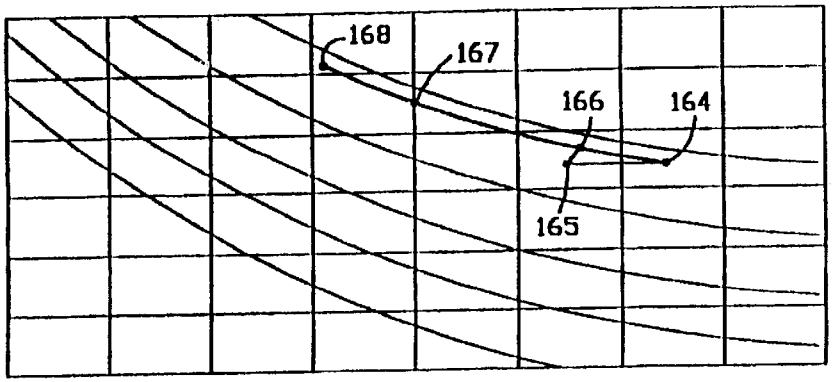

FIG. 23 shows curves of temperature, pressure and ammonia solution in water ratio which are applied in examples. The fluid mixture cycle starts at 165 and it may be pressurised isothermally in a shaft to state of condition 164. The pressurised mixture expels heat in the transition. If the expelled heat is consumed at constat pressure the fluid will change its condition of state from that at 165 to 168 or to a condition between 168 and 164 according to the handling of expelled heat.

SUMMARY

The invention applies the theory of thermodynamics, based on two laws. The first law was redefined to include mass to energy conversion in atomic reactions. The second law holds exactly when applied as defined e.g. a Camot cycle or a single temperature entropy diagram (T-s diagram). No reference to the second law could be traced which refers to T-s countercyles. New investigations were conducted on the influence of energy other than heat and work energy together with a T-s diagram, like it's combination with velocity energy etc, acting simultaneously. The state of art is shown in FIGS. 1, 2 and 3. Countercycles are shown in FIG. 4 and multiple countercycles in FIG. 5. T-s cycles with temperature plotted on a positive scale and negative scale are shown in FIGS. 6 and 8 to illustrate that a component of the state of condition of the T-s diagram can simulate fluid in a column (48). The common T-s diagram in FIG. 6 is inappropriate.

Heat, temperature, pressure and work specifications can split a T-s cycles as shown in FIG. 10. The two fractional cycles together with gravity and catalistic vapour solution are shown in FIGS. 11 and 12, and the combination of two fractional diagrams in combination with gravity in FIG. 13. The oversupply work 135–152 minus input can be withdrawn with no additional reference to heat demand and supply. This work is gravitational and chemical work tendered with the implementation of thermodynamics. Running the diagrams in FIG. 13 shows that work can be delivered with no heat supply. This must freeze the system. To reach stability, heat must be supplied. This heat input, can be supplied at any workable position in FIG. 13. If input heat comes from the surround the application of the invention will freeze the surround.

Heat mass is applied in recirculation of at least one cycle of a system of countercycles in at least two working columns to convert heat energy into work energy by applying gravity and chemistry. The heat mass of the two fluid systems may be equal. One of the cycles may dominate the thermodynamic behaviour of the other. One of the fluids may liquefy when moving upwardly along one of the columns. The fluid in liquid form in the one column may drench the fluid in the other column and may evaporate the condensed fluid. The difference in the fluid densities may cause a pressure difference at the bottom of the columns. The arrangement may be such that the pressure difference may yield output power and may require heat input.

The combined mass of multi-cycles may enforce excessive enthalpy in fluid at an enforced intermediate entropy level of fluid(s) in shafts to enable heat to be converted to power.

The system may apply carbon dioxide or mostly carbon dioxide to form a countercycle converter and/or a recycling countercycle to change heat energy into work energy.

The system may operate with column(s) and fluid(s) at drenching as well as preheating of very high orders, which may equal or exceed 50%, on condition that drenching plus preheating does not exceed 100%.

The system may recirculate energy in one or more cycles in countercycles to convert heat energy into power at an efficiency of up to 100%.

The first aspect of the invention produces power generation by combining thermodynamics, catalysts and gravity in T-s Internal countercycles and gravitational work as shown in FIGS. 10 to 13. The variable catalyst action is not displayed. The preferred layout is shown in FIG. 15, including the positions where appropriate state of conditions numbers 134, 135, 152, 159 and 160 of FIG. 13 apply. State of condition point 134 in the figures does not pre-specify the entropy of point 134. The percentages drenching and preheating are therefore not pre-specified. Apply liquid in column 193 and vapour in columns 192 and 199 of FIG. 15. The state of condition points 159 and 106 apply in column 199 to simulate low entropy fluid. To produce power the pump 195 must be applied.

EXAMPLE 1

Process Scarel Apply the internal T-s countercycle process on the fluid consisting of "pure" $CO_2$ and water as a catalyst operating at −8° C. at a pressure of 2.8 MPa and 60% drench plus 40% preheat in a 286 m vertical column. The calculated results show that the minimum power yield is 1.52 kJ/kg $CO_2$ (4 kg cycle). To obtain "120 megawatt" it will be required to circulate 315.2 Ton/sec of $CO_2$ and the total mass of fluid in the three shafts in FIG. 15 must be 30047 tons of $CO_2$ flowing at an average speed of 3 meters per second. As shown in FIG. 2 the three columns fit in a circular shaft of 28.4 m diameters.

EXAMPLE 2

Process Fanie To produce 120 megawatt power in example 1 it requires heat input at −8° C. equivalent to 120 megawatt. The input heat may be withdrawn from water stored at 10° C. and cooled to become ice at 0° C. A kilogram water delivers 352 kilojoules heat to become ice. At full capacity process Fanie will produce 1225.2 ton ice per hour which becomes 0.882 million kiloliters potable water per month, on top of the power delivery of example 1.

The second aspect of the invention specifies that heat must be supplied somewhere in FIGS. 14 and 15 otherwise the first aspect will create operations of indefinite freezing. The heat may be supplied at any temperature above the state of condition points of FIG. 13. Most of the examples calculated start at temperatures below freezing point. The heat may originate from running water which may be frozen. If polluted water or sea water is frozen the ice is not chemically polluted. Pollution components may be separated and exploited. The ice, when melton, is consumable water to be sterilised to be potable in general.

An extension of the second aspect shows that the system in the first aspect produces a global freezer applicable in all applications of freezing.

The Third aspect of the invention claims that the power required for sprinkler irrigation may be withdrawn from the water to be sprinkled, that sprinkling with cooled irrigation water causes less evaporation from the sprinkled water and provides better quality water to the soil being sprinkled.

EXAMPLE 3

Withdraw heat from flowing water applied at a sprinkler or a township to deliver 300 kilowatt in a shaft of 40 meter depth. The 300 kilowatt is sufficient to drive a sprinkler irrigation spill point system or a township's power demand. Lowering of the temperature of the flowing water by 5° C. reduces the spill point water evaporation during sprinkling. More than 5° C. lowering may be applied. The column diameters for power from the sprinkler system are: 1.8 m for compressed air, 1.5 m for the mix column, 0.29 m for the water column and if the two smaller columns are contained in the large column its diameter must be 2.2 m.

The Fourth aspect of the invention claims that principally the layout in FIGS. 14, 15 and 17 implies that energy is recirculated. To create stability in FIG. 13 it is required that power may be withdrawn at 135–152 in FIG. 13 and the same amount of heat returned, to complete the internal countercycle associated with gravitational acceleration.

Fluid following the T-s thermal path of a theoretically closed thermodynamic cycle is in fact ideally a circulating system with specification for the boundary value input and output.

In other professions and trades the continued use of matter is called recycling. This often happens without a change in substance. In thermodynamics countercycles recycling, may yield more work without consuming proportionally more heat. The rate off flowing of one or both cycles in FIG. 13 may be changed.

Instability caused by oversupplying input heat and/or producing less power will systematically increase the global temperature like a heater. Stability can be reached by disposing of heat, similar to thermal power stations.

An operating layout may be unstable and satisfying boundary conditions temporary. Recycling may be over driving power production without sufficient increases of input heat, like a refrigerator or like closing a thermal power station. The temperature level of the whole layout will then decrease, operating as a global freezing unit. Stability is reached by any of:

consuming heat from the exterior input heat leaking to the set up cooling another layout stopping.

It is obvious that the fluid of an internal countercycle power station, as described above, can be recirculated or one cycle may be recycled according to design specifications and boundary conditions. Between the conditions described above, stable energy recycling, nominal heat input and power output will cause conversion of heat into power at efficiencies approaching 100%.

The Fifth aspect of the invention is to operate preceding aspects with fluids which are not hostile to life. The most common fluids in life are water and air which are applied in example 4. Ammonia is a good catalyst which is not human friendly. For the example assume that 120 Megawatt must be produced in three columns of 96 m length, that the heat intake temperature is 4° C. and drenching is 60%.

EXAMPLE 4

Process Jaja: Apply the preferred layout in FIG. 15 to circulate air catalysts and water compressed to 3.0 MPa. Water is contained in 196, 193 and 187, and the air flows in 199 across heat supply 185. It becomes mixed with water in 187, compressed in 192, and delivers power in 194. The starting temperature at 187 is 4° C., allowing for heat input at 185 from reject heat at thermal power stations, water or mine ventilation. Calculations apply a 10 m/sec flow rate to show that 120 Megawatt is generated by re-circulating 2 931 ton of water and 1 961 ton of air filling the 96 m tall columns. The column excavation volume is $55.3\times10^3$ $m^3$. In this example the increase in operating pressure from 3.0 MPa to 3.084 MPa apply at the 96 meter shaft bottom. The layout can be fitted in 3 shafts of average diameter 23.3 m (air), 192 m (mix) and 3.7 m (water), or the 3 columns in one shaft of 28 m diameter. To reduce the diameters the shaft lengths may be extended.

The Sixth aspect is that example 4 may be scaled down to be installed in operating mines for the provision of power and simultaneously airconditioning the mine.

EXAMPLE 5

Process Fanie: Compare the power delivered by hydraulic means with power delivered by one of the invented methods.

The latter consumes energy by lowering the temperature of the water by 5° C. Given: Vanderkloof dam delivers 120 Megawatt hydroelectricity on consuming up to 217 $m^3/s$ water at a hydraulic head approaching 96 m. The invented method tested here, applies 20% drenching to R125 CFC gas mixed with carbon dioxide in four columns of 96 m. Heat extracted to lower the temperature of 217 $m^3/s$ water by 5° C. equals 4542 megawatt. This is 37.85 times more than the delivery capacity of the hydroelectric installation at Vanderkloof dam.

The compared invented method applies 20% drenching to R125 to improve the output according to FIG. 17, and applies velocity energy to regulate the process.

The seventh aspect of the invention is to apply catalytic action in the production of power. It improves the efficiency of the layout as shown in examples 6 and 7.

EXAMPLE 6

Show that catalytic action can be applied together with internal countercycle power generation. With reference to FIG. 23, start at state of conduction 165 for the mass composed of 15% ammonia gas at 0.3 MPa and 290 K, 35% liquid water and 50% nitrogen gas or other non-reacting fluid at 8.0 MPa and 290 K. According to Dalton's law the total pressure should be 8.3 MPa and after lowering by 250 m as shown in FIG. 15 the pressure at 198 should be 8.4 MPa. Isothermally the 15% ammonia gas should dissolve completely in the water and release 180 kilojoule heat for 1 kg fluid. According to the design most of this heat will be consumed in ammonia gas forming after power delivery. In the heated intermediate stage the heat can produce power. The liquid is recycled with pump 195 and the ammonia gas will circulate along 198 and 199 to be drenched again at 187 to complete the cycles. The exact output power at 194 will be more than 10 kJ/kg fluid,-depending on the design.

EXAMPLE 7

The catalytic action in example 6 will operate in a mechanical layout consisting of a compressor(s) and/or centrifuge(s) for compression, an expander(s) to produce power and heat exchanger(s) for heat input to complete the internal counteracting T-s diagram in FIG. 13.

The examples 6 and 7 demonstrate that the pressure and temperature sensitivity of the solubility of ammonia in water (FIG. 23) can be applied as shown in FIG. 14. The evaporation and condensation heat is successively conveyed to compressed nitrogen or other fluid to do the additional work.

The eight aspect of the invention expands on the fifth aspect, in so far as the combination of gravitational energy plus catalytically produced energy is more than gravitational energy. Catalytically supplied heat may be withdrawn by applying centrifuges and expanders to produce power.

The ninth aspect of the invention modifies the power T-s cycle to produce and deliver more power from the combined countercycles. Preheating and drenching reduce the entropy interval of the power cycle, and consequently more power cycles fit inside the refrigeration cycle. The reduced power cycles individually yield less power. The total output is the product of individual power cycles times N, the number of cycles. This product increases as shown in FIG. 9.

The tenth aspect of the invention applies the well known hysteresis loop between evaporation and condensation of a varying mixture of two fluids as shown in FIG. 18, together with the distortion of loops by gravitational action in shafts as shown in FIG. 19. On regulating the temperature in two shafts the distorted loop displayed in FIG. 19 yields various percentages of the mixed fluids $X_1$ and $X_2$, as shown by analyzing line 68 to 69 in relation with line 70 to 71. Skew displays, to advance power production as shown in FIG. 20, are obtained by regulating the temperature related via the velocity of flow to the pressure. The tenth aspect is implemented in preferred layout displays shown in FIGS. 21 and 22.

EXAMPLE 8

Demonstrate that power production operates in two columns as shown in FIG. 21. Consider $CO_2$ and CFC called HP80 on the assumption that no chemical reaction occurs between the fluids. To obtain equal heat masses mix $CO_2$ and HP80 (20% drench on 20% preheat) in the ratio 28% $CO_2$ and 72% HP80. Let $X_1$ be $CO_2$ and $X_2$ be HP80. FIG. 20 shows that the vapour will contain more R125 at the bottom of the shaft and less at the top of the shaft. The fluid specific volumes of 18 and 11 l/kg confirms that $CO_2$ gas will move down and HP80 gas will move up, to condense and avail HP80 liquid at the top of the column to a much bigger extent than $CO_2$ liquid. When applied in a display as shown in FIG. 21 the $CO_2$ will be highly drenched to accelerate the operation of the system.

No formula or experience avails to calculate the output. Nominal estimates show that a mass of 269 ton in a 96 m column will produce about 1.4 megawatt power production.

EXAMPLE 9

Apply fluids carbon dioxide and R125 (chemically $CHF_2CF_3$) in four columns of 10 m length and fluid mixing, as displayed in FIG. 17. Regulation occurs at 93 by velocity energy and power is generated at 97 from R125 and $CO_2$ fluid mix as well as at 83 from high entropy fluid. The R125 and $CO_2$ gas is self circulating due to densities. Production is regulated by liquid pump 103, power production pump 83, generator 97 and velocity pump 93, at a temperature of 280K. Calculations show equal heat masses for 1 kg $CO_2$ and 1.65 kg R125 if not drenched. Drenching will increase production as shown in FIG. 9. Full cycle power production is 72 J/kg of $CO_2$ circulated or 13.5 J/kg from the total mass of circulated gas and z=10 m: It can be increased by drenching. At 10% preheat, 10% drenching and fluid flow velocity 20 m/sec the power production increases to 129 J/kg total mass or 24.2 per kg of cycle mass. A practical application of the latter case shows that 3 kilowatt can be generated in a column of 10 m long and 2.2 m diameter. An enlarged layout of 120 megawatt at column height of 48 m requires an encircling shaft of 77 m diameter, which is impractical. For this capacity a column of 300 m long and diameter of 30.8 m is more proportional.

The eleventh aspect of the invention applies fluid mixing and fluid selections to eliminate two large heat exchangers of the state of the art displayed in FIG. 1. The selection of fluids yield power at 83 in FIG. 17 from density differences between vapours as shown in example 9. This is a further aspect of producing power, additive to liquid induced power production at 97 and in FIG. 17.

EXAMPLE 10

Apply the display in FIG. 22 to generate power. The display shows two independently acting mechanisms. The first is liquid store 204, liquid pump 207 and at 205 a generator of velocity energy which is mostly recoverable. The second mechanism consists of heat source 206 supplying energy to vapour 203 which, as a result of heating, is of smaller density than vapour 202. In the columns the difference in density causes circulation and therefore deliver power at 201. If the rotation speed is increased from (say) 1 to 10 m/s by velocity energy, the vapour power delivery will increase ten times. Given the vapour ethylene ($C_2H_4$) at 265 K, 3.35 MPa having S=−1.519 which is combustible but not fired. Operations run at about −8° C. and the liquid in 204 is also ethylene. Create an entropy level on leaving 205 to be on the liquid saturation line. Energy from 206 will expand the fluid gas to cause a light density in column 203. On withdrawing power at 201 the temperature and pressure drops and the gas in 203 will be drenched by fog in 202, which enhances the vapour power production induced by gravity in the columns. No data for sample calculations avail.

EXAMPLE 11

Apply the reject heat of the thermal power station Lethaba (heat from coal) on applying the process described in example 4, operating at −8° C. according to the example. The reject heat from the thermal process can be converted to power in total. Assume the six times 618 Megawatt Lethaba power station runs at 45% efficiency then the example referred to, will deliver an extra 4532 Megawatt and on top it will save about 58 million cubic meter water from Vaaldam applied to evaporate the power station reject heat.

The twelfth aspect of the invention involves a system to run countercycle power production inside two only columns for fluid flow. The columns are coupled intermediately with liquid conveyance pipes for drenching and pressure isolation, as shown in FIG. 21. In example 8 it was shown that the T-x behaviour in FIG. 20 dominates evaporation and delivers high density $CO_2$, well drenched, to reach power converter 115 and yield output power. The rate of power production will be influenced by velocity inducer 121. The heat input 113 in FIG. 21 and the velocity generator 121 dominate the production of the system.

The thirteenth aspect of the invention applies internal fluid drenching in 2 columns as shown in FIG. 22. The condition of state of the two fluids in 203 and 202 impel circulation and output power generator 201 and heat input 206 establish a temperature according to production.

Display 208 is designed to operate near the vapour saturation line of a fluid and operates well if the vapour density is high, e.g. for $CO_2$ which can be applied to operate between +30° C. and −100° C., depending on the quality of the input heat source.

The Fourteenth aspect of the invention relates to the residues left over after water extraction by freezing. This is a field by itself. Reference may be made to mineral extraction from the dead sea and to sea salt extraction at Port Elizabeth, both as a result of water removal.

The Fifteenth aspect of the invention relates to a practical design and application of the invention operating in water. The entire power station may float in water. The mass of air in the power station, functioning for example on water heat, water, a catalyst and air, can be increased to reach the air pressure required for optimal functioning. The air mass increases the density of the global power station. Consequently the power station will sink down the water and stabilise at the bottom of the water. On stabilisation the production of power may commence. Being stable at the bottom the power station cannot move round as a result of waves or water current during operation. If repairs have to be made, the high pressure air and/or water masses are released, the power station will float like a ship and normal open air repairs can be applied to the power station as a whole. The external water pressure counters internal pressure of the power station, yielding an economical design.

The design is normally tested at twice the open air operational pressure. If the external water pressure is three times the operational pressure the internal air pressure can be raised to (1+3)=4 times the open air design pressure, eg, design the power station for one MPa, cover the power station with 300 m of water (supplying operating heat) and operate the power station at four MPa. This reduces the physical size of the power station to a fraction of the equivalent size of a 4 MPa open air power station.

The sixteenth aspect of the invention relates to the stability of an under water power station and the stability of power generating equipment in the power station. Displays 12 in FIG. 2 shows high entropy fluid(s) in a fraction of the circumferential column area and low entropy fluid(s) in the other fraction of the column area. This is thermally well in rock but will cause tilting in water. Under water the circumferential column can be prevented from tilting by placing columns 14 and 15 in opposing positions in column 13 and by choosing column flow speeds in 14 and 15 to equalize the mass distribution in column 13.

DESCRIPTION OF PREFERRED EMBODIMENT OF THE INVENTION

The layout 186 in FIG. 15 is the preferred layout. It lends itself to scaling, power production and the freezing of water to yield potable water. An appreciable advantage of the three column layout compared to the two and four column layouts vests in the fact that evaporation and condensation of the two fluids are mechanically enforced.

The system 186 comprises three columns namely 191, 193 and 199. Column 199 contains gas, drenched vapour and/or vapour. Column 193 contains liquid, preheated liquid and/or low entropy vapour. Column 191 contains a fluid mixture consisting of liquid plus vapour and/or gas. The system 186 further includes a pump 195 for circulating liquid or low entropy fluid by force; an electric power generator 194; a drenching disperser 187 a fluid mixer 134; a heat input 185. If required velocity energy for circulation may be applied at 187 by over pressurising pump 195.

The three columns 191, 193 and 199 are filled with a mixture of a suitable fluid or pure fluid such as a refrigerants HP80 and F125 mixture or pure carbon dioxide. For ease of calculation purposes, it is assumed that column 193 and sump 196 contain liquid only.

To produce power the liquefied fluid of high density 196 is elevated with pump 195 along 193 and dispersed in 187 and 134. Partly or wholly gasified fluid 199 of low density is elevated against gravity by induced vacuum or mechanical circulation if necessary and mixed in 189, providing mechanical circulation. At 134 the action may include jetting and/or drenching.

Note that the division line 134 to 149 in FIG. 12 depicts a refrigeration cycle component and lines 134 to 141 in FIG. 11 depict a power cycle component. The fluid state of condition points of FIG. 13 are indicated in FIG. 15 showing the work output cancelled by gravity in 159 to 160 in column 199.

The input work against gravity in FIGS. 13 and 15 extends from 153 through pump 195 to the high pressure stage 155 and pressure is decreased by flowing against gravity to state of condition 135 to 134 at the top of column 191. For ease of calculation assume a 50% mass mixture of gas and liquid at disperser 187. One kilogram per second fluid in columns 193 and 199 result in 2 kilogram fluid per second in column 191. The state of condition of fluid in column 191 change from 134 to 152. In passing through power generation 194 the state of condition becomes 135 to be separated into liquid 154 and gas 159. This completes the power generation countercycle in FIG. 15 as well as the thermodynamic cycle in FIG. 13. Assume a shaft length of $z_o$ from $h=mgz_o$ in which h is enthalpy change of gas from 159 to 160.

If $m_1$ is the mass flow rate of liquid, $m_2$ the mass flow rate of vapour and/or gas and $z_o$ the column depth the analysis of work in FIG. 13 shows.

Work input in column 193 (153 to 187)$=-m_1gz_o$

Work input in column 199 (155 to 153)$=-m_2gz_o+hm_2=0$

Work output in column 191$=m_1gz_o+m_2gz_o-hm_2$

Netto work output$=hm_2+m_2gz_o=0$

The theoretical analysis does not explain why work can be withdrawn from 152 to 135 in FIG. 13. If a catalyst is included in the fluid it will decrease the temperature of 134 d increase the temperature of 152, to produce more output power.

What is claimed is:

1. A combined cycle power generating system applying gravitational compression and decompression of a suitable fluid in a closed circuit in which input heat is transferred to the fluid at one point in the circuit and output power is extracted from the fluid at another point in the circuit, wherein the power generating system comprises a power generating cycle and a thermodynamically countercycling refrigerating cycle, wherein the power generating cycle and the refrigerating cycle co-operate as internal countercycles of the combined cycle, and the power generating cycle and the refrigerating cycle share at least one common operating entropy state of condition point of the fluid.

2. A combined cycle power generating system as claimed in claim 1, wherein the common operating entropy state of condition point is selected such as to fall between a first point representing a two-phase vapor/liquid combination and a second point representing a sub-cooled liquid.

3. A combined cycle power generating system as claimed in claim 1, wherein the input heat is applied at any temperature from the coldest to the hottest conditions of state of the fluid in the circuit.

4. A combined cycle power generating system as claimed in claim 1, wherein the fluid comprises a substance which is evaporated in one part of the cycle and condensed in another part thereof.

5. A combined cycle power generating system as claimed in claim 4, wherein the substance is carbon dioxide.

6. A combined cycle power generating system as claimed in claim 1, wherein the fluid comprises at least two substances.

7. A combined cycle power generating system as claimed in claim 6, wherein the two substances are water and air.

8. A combined cycle power generating system as claimed in claim 7, wherein the fluid comprises, in addition, a relatively high density vapor or gas for increasing the fluid density.

9. A combined cycle power generating system as claimed in claim 8, wherein the high density gas is selected from carbon dioxide and xenon.

10. A combined cycle power generating system as claimed in claim 6, wherein the two substance are water and carbon dioxide.

11. A combined cycle power generating system as claimed in claim 6, wherein the two substances are water and ammonia.

12. A combined cycle power generating system as claimed in claim 1, wherein the gravitational compression is augmented by mechanical compression.

13. A combined cycle power generating system as claimed in claim 1, wherein gravitational compression and decompression are achieved by means of two or more columns forming part of the circuit, and in that the columns extend from a higher level to a lower level.

14. A combined cycle power generating system as claimed in claim 1, wherein the output power which is extracted from the system causes the temperature of the fluid to be reduced, permitting the system to be used as a freezer.

15. A combined cycle power generating system as claimed in claim 1, wherein the output power which is extracted from the system causes the temperature of the fluid to be reduced, permitting the system to be used as an air conditioner.

16. A combined cycle power generating system as claimed in claim 1, wherein in one portion of the circuit, a liquid is conveyed, in that in another portion of the circuit a vapor derived from the liquid is conveyed, and in that the gravitational compression of the vapor is enhanced by drenching thereof with a portion of the liquid.

17. A combined power generating system as claimed in claim 1, wherein the circuit comprises a first substantially vertical column for conveying a fluid from a lower level to a higher level, in that the circuit comprises a second substantially vertical column for conveying the fluid from the higher level to the lower level, in that heat is transferred to the fluid in at least one position in the circuit and in that power is extracted form the fluid in at least one other position in the circuit.

18. A combined cycle power generating system as claimed in claim 17, wherein the fluid comprises two substances which are completely soluble in one another at all operating temperatures of the system.

19. A combined cycle power generating system as claimed in claim 18, wherein the latent heat of evaporation of the one substance is substantially more than the latent heat of evaporation of the other substance, so as to cause preferential condensation of the one substance to result in drenching of the vapor of the other substance, which in turn causes the fluid to self-circulate.

20. A combined cycle power generating system as claimed in claim 1, wherein the circuit comprises a first substantially vertical column for conveying a liquid from a lower level to a higher level, in that the circuit comprises a second substantially vertical column for conveying a vapor from the lower level to the higher level, in that the circuit comprises a third substantially vertical column for conveying a mixture of the liquid and the vapor from the higher level to the lower level, in that heat is transferred to the fluid at any position in the circuit and in that power is extracted form the mixture at the lower level in the third substantially vertical column.

21. A combined cycle power generating system as claimed in claim 1, wherein it is continuous in that it comprises a first column for conveying air from a lower level to a higher level causing the air to expand as its pressure decreases, in that it comprises a second column for conveying a mixture of air, water vapor and liquid water from the higher level to the lower level, thereby compressing the air forming part of the mixture, and in that it comprises a third column for conveying liquid water displaced by a pump from the lower level to the higher level.

22. A combined cycle power generating system as claimed in claim 1, wherein the circuit comprises a first substantially vertical column for conveying a first liquid from a lower level to a higher level, in that the circuit comprises a second substantially vertical column for conveying a first vapor derived from the first liquid from the higher level to the lower level after heating by the second fluid, in that the circuit comprises a third substantially vertical column for conveying a second liquid from the higher level to the lower level, in that the circuit comprises a fourth substantially vertical column for conveying a second vapor derived from the second liquid from the lower level to the higher level, in that heat is transferred from the first liquid to the second liquid at the lower level and in that power is extracted form the second liquid in the proximity of the lower level.

23. A combined cycle power generating system as claimed in claim 22, wherein the first and second liquids are selected on the basis that the variations in their boiling points caused by variations in pressure are sufficient to cause the first and second vapors to self circulate in the circuit.

24. A combined cycle power generating system as claimed in claim 1, wherein the fluid comprises two liquids which are soluble in one another and in that variations in the boiling point of the one substance caused by variations in pressure are substantially more than variations in the boiling point of the other substance caused by the same variations in total pressure.

25. A combined cycle power generating system as claimed in claim 1, wherein the fluid comprises, in addition a substance capable of increasing the mass heat conveyance of the fluid.

26. A combined cycle power generating system as claimed in claim 1, wherein the fluid is not toxic to humans in addition, the substances are oxygen enriched to support life and that power generation is catalistically or chemically accelerated.

27. A process for producing water of improved quality from water of undesirable quality wherein the process includes the step of removing heat from the water of undesirable quality, in that said heat is transferred to a suitable fluid circulating in a combined cycle power generating system which comprises a power generating cycle and a thermodynamically countercycling refrigerating cycle, in that the power generating cycle and the refrigerating cycle co-operate as internal countercycles of the combined cycle and in that the power generating cycle and the refrigerating cycle share at least one common operating entropy state of condition point of the fluid.

28. A process for producing water of improved quality from water of undesirable quality as claimed in claim 24, wherein the water of undesirable quality is caused to freeze at least partially, in that ice is recovered from the water of undesirable quality; and in that the ice is allowed to that to yield the water of improved quality.

29. A process for producing water of improved quality from water of undesirable quality as claimed in claim 28, wherein the water of undesirable quality is river water and in that the water of improved quality is potable water.

30. A process for producing water of improved quality from water of undesirable quality as claimed in claim 27, wherein the water of undesirable quality is river water and in that the water of improved quality is irrigation water.

* * * * *